US005255397A

United States Patent [19]

Poole

[11] Patent Number: 5,255,397

[45] Date of Patent: Oct. 26, 1993

[54] URINAL

[76] Inventor: Donald A. Poole, 23 Salvi Dr., Framingham, Mass. 01701

[21] Appl. No.: 961,800

[22] Filed: Oct. 16, 1992

[51] Int. Cl.[5] ..... E03D 13/00

[52] U.S. Cl. ..... 4/310; D23/302

[58] Field of Search ..... 4/301, 310, 311; D23/302

[56] References Cited

U.S. PATENT DOCUMENTS 1,114,670 10/1914 Baker ..... 4/310

5,027,448 7/1991 Wilkins ..... 4/310

*Primary Examiner*—Charles E. Phillips

*Attorney, Agent, or Firm*—John E. Toupal; Harold G. Jarcho

[57] ABSTRACT

A urinal including a pair of substantially vertical sidewalls having front edges lying in a plane defining an entrance opening of the urinal, and rear edges defining a substantially vertical slot, the pair of sidewalls converging inwardly so as to form a trough for guiding the flow of urine entering the entrance opening in a path transverse to the plane and toward the slot; internal walls defining a vertically oriented channel communicating with the trough via the slot, the internal walls having front edges terminating at the slot and the channel converging to a vertically oriented extremity displaced from the slot in a direction parallel to the plane and a bottom wall joined to bottom edges of the sidewalls and the internal walls and defining a drain opening. The trough and channel guide deposited urine to the shielded extremity of the channel so as to prevent splashback.

12 Claims, 1 Drawing Sheet

URINAL

BACKGROUND OF THE INVENTION

This invention relates generally to a urinal and, more particularly, to a urinal of the stall type that prevents splashback.

Urinals of the stall type, either free standing or wall mounted, are widely used in both commercial and residential buildings. A disadvantage of such urinals is their tendency to splatter deposited urine causing unsanitary conditions in and around a urinal. These problems were addressed in U.S. Pat. Nos. 1,114,670 and 5,027,448, both of which disclose urinals with structure for reducing splashback. Although providing some improvement, the urinals disclosed in those patents fail to fully solve the problem of urinal splashback.

The object of this invention, therefore, is to provide an improved urinal that substantially eliminates urine splashback.

SUMMARY OF THE INVENTION

The invention is a urinal including a pair of substantially vertical sidewalls having front edges lying in a plane defining an entrance opening of the urinal, and rear edges defining a substantially vertical slot, the pair of sidewalls converging inwardly so as to form a trough for guiding the flow of urine entering the entrance opening in a path transverse to the plane and toward the slot; internal walls defining a vertically oriented channel communicating with the trough via the slot, the internal walls having front edges terminating at the slot and the channel converging to a vertically oriented extremity displaced from the slot in a direction parallel to the plane; and a bottom wall joined to bottom edges of the sidewalls and the internal walls and defining a drain opening. The trough and channel guide deposited urine to the shielded extremity of the channel so as to prevent splashback.

According to one feature of the invention, the drain opening communicates directly with the channel. The drain opening facilitates removal of deposited urine.

According to another feature, the invention includes a mounting flange projecting from each of the sidewalls substantially parallel to the plane and away from the trough. The flanges facilitate mounting of the urinal to an exterior wall.

According to another feature of the invention, each mounting flange is disposed centrally between the slot and one of the front edges. This feature facilitates recessing of the internal wall within a parallel wall structure.

According to one embodiment of the invention, a first channel has a first vertically oriented extremity displaced in one direction from the slot, and a second channel has a second vertically oriented extremity displaced in a direction opposite to the one direction. The oppositely directed channels insure against urine splashback.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
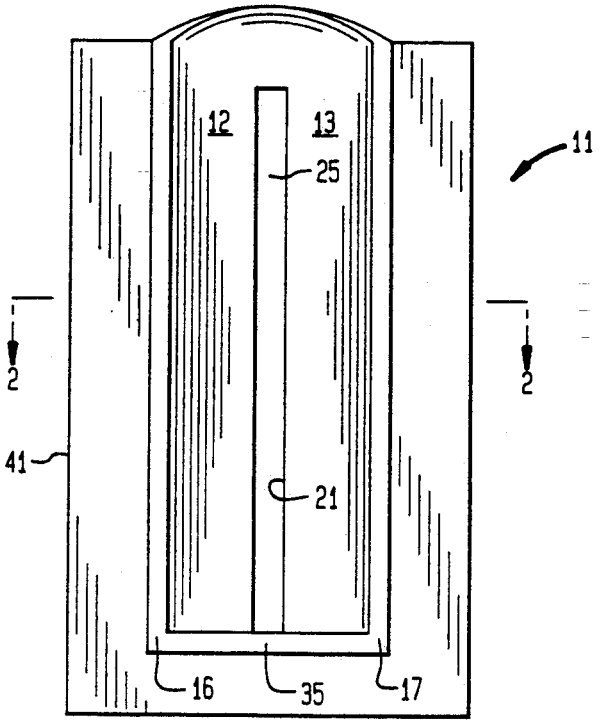
FIG. 1 is a front elevational view of a urinal according to the invention.

A urinal 11 includes a pair of substantially vertical sidewalls 12, 13 that converge inwardly so as to form a trough 14. Front edges 16, 17, respectively, of the sidewalls 12, 13 lie in a plane defining an opening 18 into the trough 14. Also opening into the trough 14 is a slot 21 defined by inner edges 22, 23, respectively, of the vertical sidewalls 12, 13.

Substantially vertically oriented internal walls 25 have front edges 26, 27 terminating at the slot 21 and joined, respectively, to the rear edges 22, 23 of the vertical sidewalls 12, 13. Defined by the internal walls 25 is a channel 31 that communicates with the trough 14 via the slot 21. A vertically oriented extremity 32 of the channel 31 is displaced from the slot 21 in a direction parallel to the plane of the entrance opening 18 of the urinal 11.

The bottom wall 35 is joined to bottom edges of the vertical sidewalls 12, 13 and bottom edge of the internal walls 25. The bottom wall slopes downwardly and rearwardly to the channel 31., Defined in the bottom wall 35 and communicating with the channel 31 is a drain opening 37. A mounting flange 41 projects from the vertical sidewall 12 away from the trough 14 and substantially parallel to the plane of the entrance opening 18. Similarly projecting in an opposite direction from the trough 14 is a mounting flange 42 also substantially parallel to the plane of the entrance opening 18. Both of the mounting flanges 41, 42 are disposed centrally between the front edges 16, 17 of the sidewalls 12, 13 and the slot 21. The mounting flanges 41, 42 are used to mount the urinal 12 to the outer wall 45 of a conventional double wall building structure with the internal walls 25 recessed between the outer wall 45 and an inner wall 46 and between studs 47 as shown by dashed lines in FIG. 2.

During use of the urinal 11, urine deposited through the entrance opening 18 is guided by the vertical sidewalls 12, 13 toward the slot 21. After passing through the slot 21, urine is sharply redirected by the internal walls 25, toward the extremity 32 of the channel 31. Urine reaching the extremity 32 of the channel 31 flows downwardly along the internal walls 25 and is discharged through the drain opening 37. Because no lines of direct access exist between the entrance opening 18 of the urinal 11 and the shielded channel 31 formed by the internal walls 25, urine splashback is substantially eliminated by the urinal 11.

Figure 3:
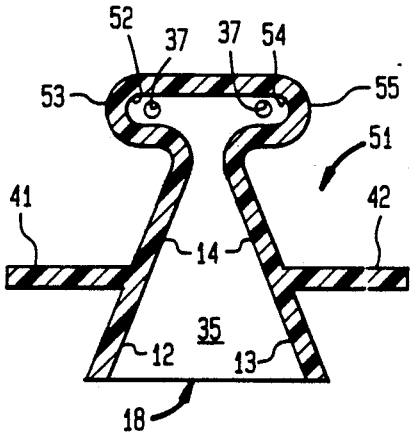
FIG. 3 is a top view of another urinal embodiment of the invention.
Figure 2:
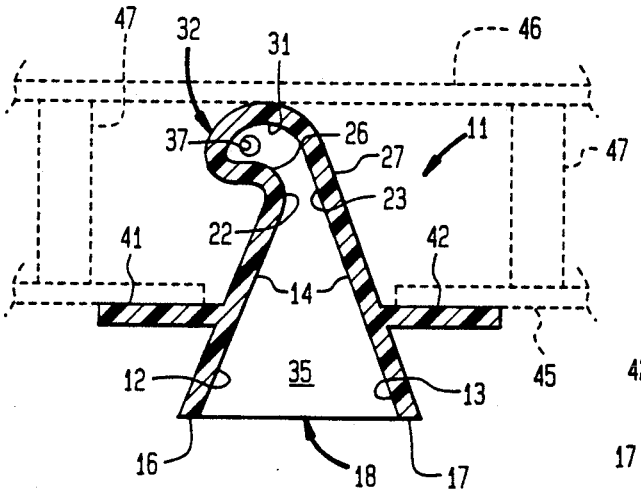
FIG. 2 is a top view of the urinal shown in FIG. 1.
Figure 2A:
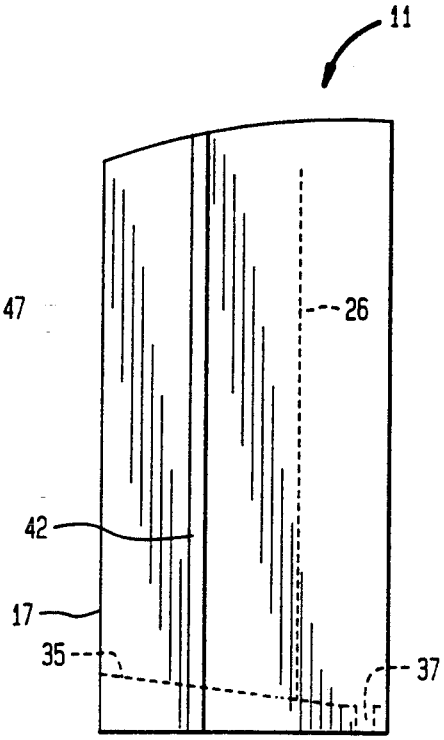
FIG. 2*a* is a side view.

Illustrated in FIG. 3 is another urinal embodiment 51 in which portions similar to those of the embodiment 11 in FIGS. 1 and 2 have been given identical reference numerals. In the embodiment 51, substantially vertically oriented internal walls 52 longitudinally form a first channel 52 having a first vertically oriented extremity 53 displaced in one direction from the slot 21 and a second channel 54 having a second vertically oriented extremity 55 displaced in an opposite direction thereto. Again, the first and second extremities 53, 55 are displaced from the slot 21 in directions substantially parallel to the plane of the entrance opening 18.

During use of the embodiment 51, urine deposited in the trough 14 is directed into either the first channel 52 or the second channel 54. In either case the absence of direct lines of communication between the shielded channels 52, 54 and the entrance opening 18 substantially eliminates urine splashback.

Obviously, many modifications and variations of the present invention are possible in light of the above teachings. For example, although free standing urinals 11, 51 have been disclosed, it will be obvious that the inventions disclosed can be used equally well for wall mounted urinal types. Also, the urinals 11, 51 would preferably be provided with the conventional paraphernalia for use in flushing. It is to be understood, therefore, that the invention can be practiced otherwise than as specifically described.

What is claimed is:

1. A urinal comprising:

a pair of substantially vertical sidewalls having front edges lying in a plane defining an entrance opening of said urinal, and rear edges defining a substantially vertical slot, said pair of sidewalls converging inwardly so as to form a trough for guiding the flow of urine entering said entrance opening in a path transverse to said plane and toward said slot;

an internal wall defining a vertically oriented channel communicating with said trough via said slot, said internal wall comprising front edges terminating at said slot and said channel converging to a vertically oriented extremity displaced from said slot in a horizontal direction parallel to said plane; and a bottom wall joined to bottom edges of said sidewalls and said internal wall and defining a drain opening.

2. A urinal according to claim 1 wherein said drain opening communicates directly with said channel.

3. A urinal according to claim 2 including a mounting flange projecting from each of said sidewalls substantially parallel to said plane and away from said trough.

4. A urinal according to claim 3 wherein each of said mounting flanges is disposed centrally between said slot and one of said front edges.

5. A urinal according to claim 1 wherein said channel comprises a first channel having a first vertically oriented extremity displaced in one direction from said slot, and a second channel having a second vertically oriented extremity displaced in a direction opposite to said one direction.

6. A urinal according to claim 5 wherein said drain opening communicates directly with said channel.

7. A urinal according to claim 6 including a mounting flange projecting from each of said sidewalls substantially parallel to said plane and away from said trough.

8. A urinal according to claim 7 wherein each of said mounting flanges is disposed centrally between said slot and one of said front edges.

9. A urinal according to claim 5 including a mounting flange projecting from each of said sidewalls substantially parallel to said plane and away from said trough.

10. A urinal according to claim 9 wherein each of said mounting flanges is disposed centrally between said slot and one of said front edges.

11. A urinal according to claim 1 including a mounting flange projecting from each of said sidewalls substantially parallel to said plane and away from said trough.

12. A urinal according to claim 11 wherein each of said mounting flanges is disposed centrally between said slot and one of said front edges.

* * * * *